US006427619B1

(12) United States Patent
Cornell

(10) Patent No.: US 6,427,619 B1
(45) Date of Patent: Aug. 6, 2002

(54) OPEN-TROUGH KAYAK LEEBOARD KIT

(76) Inventor: Christopher P. Cornell, 5 N. Woodland Ave., East Brunswick, NJ (US) 08816

( * ) Notice: Subject to any disclaimer, the term of this patent is extended or adjusted under 35 U.S.C. 154(b) by 0 days.

(21) Appl. No.: 09/839,868

(22) Filed: Apr. 23, 2001

(51) Int. Cl.[7] ..... B63B 35/00
(52) U.S. Cl. ..... 114/347; 114/126
(58) Field of Search ..... 441/79; 114/347, 114/126, 127, 132, 138, 140, 141

(56) References Cited

U.S. PATENT DOCUMENTS 3,839,978 A * 10/1974 Hendrickson ..... 114/39.22
4,862,818 A * 9/1989 Sullivan ..... 114/126

* cited by examiner

*Primary Examiner*—Stephen Avila
(74) *Attorney, Agent, or Firm*—Charles I. Brodsky

(57) ABSTRACT

An open-trough kayak sailing accessory kit is described in which a removable, portable, lightweight bi-pod mast is mounted to a removable board/hatch at the front of the kayak. The mast then tilts back over the kayak so as to center the sail over the craft. The bi-pod mast is hinged to the board and has various rope securement points to give it fore and aft stabilization. To provide lateral stability to the kayak, a leeboard kit according to the invention is included, having a leeboard removably affixed to the side of the cockpit of the open-trough kayak where no cross bars or flat top surfaces for attachment are otherwise present. A slide clamp is employed which fits the side of the open cockpit, in allowing the leeboard to rotate about the clamp, permitting a user to raise and lower it into the water as needed. By employing the two kits together, an open-trough kayak can easily be utilized for ocean sailing, otherwise quite difficult to do.

19 Claims, 6 Drawing Sheets

OPEN-TROUGH KAYAK LEEBOARD KIT

FIELD OF THE INVENTION

This invention relates to sail kits, in general, and to a sail kit and leeboard kit for converting an open-trough kayak into a sail boat, in particular.

BACKGROUND OF THE INVENTION

As is well known, there presently exists an increasing interest in ocean going kayaks, and more specifically in those which have an open-trough. Unlike a traditional kayak—which includes an opening near its center to sit within, extending the legs within the front of the craft—the open-trough kayak utilizes a shallow, scooped-out exposed trench for seating. As the interest in open-trough kayaks increases, so does the desire to modify them for such alternative use as sailing.

Several sailing accessory kits have been available for canoes, boats and center-hole kayaks having both a mast and some manner of leeboard for stability. In most instances, these kits are generally undesirable as they necessitate material revision to the canoe, boat or kayak itself. For example, the sail support has to be fixed in place for use, and then cannot be easily removed.

Moreover, these, accessory kits all require a deep exposed hull for operation—such as a row boat, or with a deep open cockpit as in a center-hole kayak—for installing the mast and assorted hardware. Typically, for example, the lower end of the mast is positioned at the bottom of the craft. Leeboards, needed for lateral stability, are usually then integrated into mast support cross members, to position the leeboard(s) out and over the side of the craft.

Such available kits cannot be used in an open-trough kayak, however, as the kayaker there sits on top of a shallow open trench, visible from head to toe while paddling. No top deck exists as on an enclosed kayak, nor are there cross bars as present in a canoe. And, no locations are available to secure a traditional "Marconi Rig" mast, or a "leeboard" for stabilization.

OBJECTS OF THE INVENTION

It is an object of the present invention, therefore, to provide an arrangement for attaching a mast to an open-trough kayak in a non-destructive manner, so as to permit it to be driven by wind power.

It is also an object of the invention to provide a removable leeboard for an open-trough kayak which is lightweight, compact, and easily retractable.

It is another object of the invention to provide a sailing accessory kit for an open-trough kayak which can fit into a small duffle bag for easy transport.

SUMMARY OF THE INVENTION

As will become clear from the description that follows, the present invention relates to these open-trough kayaks and addresses, in one respect, the use of a sailing kit which will enable them to be driven by the wind in the manner of a sail boat. The construction will be seen to be one which allows the kit to be added to, or removed from the kayak without destructively modifying it or changing its handling characteristics in any way.

As will become clear, the sailing kit attaches at a point substantially level with the gunwales of the open-trough kayak, and is capable of supporting a bi-mast in rearward leaning position so as to position the sail over the center of the kayak, even though the lower terminus of the mast is positioned towards its front. The construction described includes a supporting plate which removably secures over the front storage well of the kayak, with substantially the same dimensions so as to fully cover the well while permitting a secure fastening method. A bi-pod mast is then fixed to the top of the supporting plate and tilted rearwardly over the center of the kayak, where it is supported in place by its integrated rigging. As will be described, the mast is designed to permit the attachment of both a jib sail and a main sail in presenting the greatest surface area to catch the wind. To provide lateral stability in the water, a unique leeboard kit is also set out according to the invention, which removeably clamps over the side gunwale cockpit trench and permits easy, one handed, elevation by a user when sailing into shallow water so as not to contact the bottom. The leeboard will be seen to be constructed in a manner to be lightweight, and designed to substantially hug the side of the kayak, thereby avoiding the possibility of listing to one side when the leeboard is in its upright position.

In addition, a securement arrangement is integrated into the leeboard mounting bracket to permit the attachment of the control lines for a stern mounted rudder by which the kayak may be steered. With such an arrangement, it will be appreciated to be unnecessary to bore through the kayak or to drive screws into the it, thereby changing its structure.

As will be particularly described hereinafter, the open-trough kayak sailing accessory kit according to one aspect of the invention is in the nature of a compact, lightweight kit including a bi-pod mast, a mast mounting plate, mast rigging, sails, a leeboard, and a rudder. In the preferred embodiment shown, the mast mounting plate is generally constructed in the form of a flat tapered board with a hinged mount for attaching the bi-pod mast, and with a cross member for attaching various rigging and tie downs. The tapered board is notched along it sides to permit strapping which secures it to the top of the open-trough kayak—to provide a tight fit, and to prevent slippage.

As will also become clear, the leeboard kit according to a second aspect of the invention is constructed in a sufficiently lightweight manner to prevent the kayak from becoming unbalanced and listing to one side. Integrated into the leeboard hardware are several additional attachment points for securing the board fore and aft, and for attaching a line to a rear mounted rudder. In the preferred embodiment of the invention illustrated, latches are employed to fix the leeboard to the gunwale.

BRIEF DESCRIPTION OF THE DRAWING

These and other features of the present invention will be more clearly understood from a consideration of the following description, taken in connection with the accompanying drawings, in which.

DETAILED DESCRIPTION OF THE DRAWINGS

Figure 1:
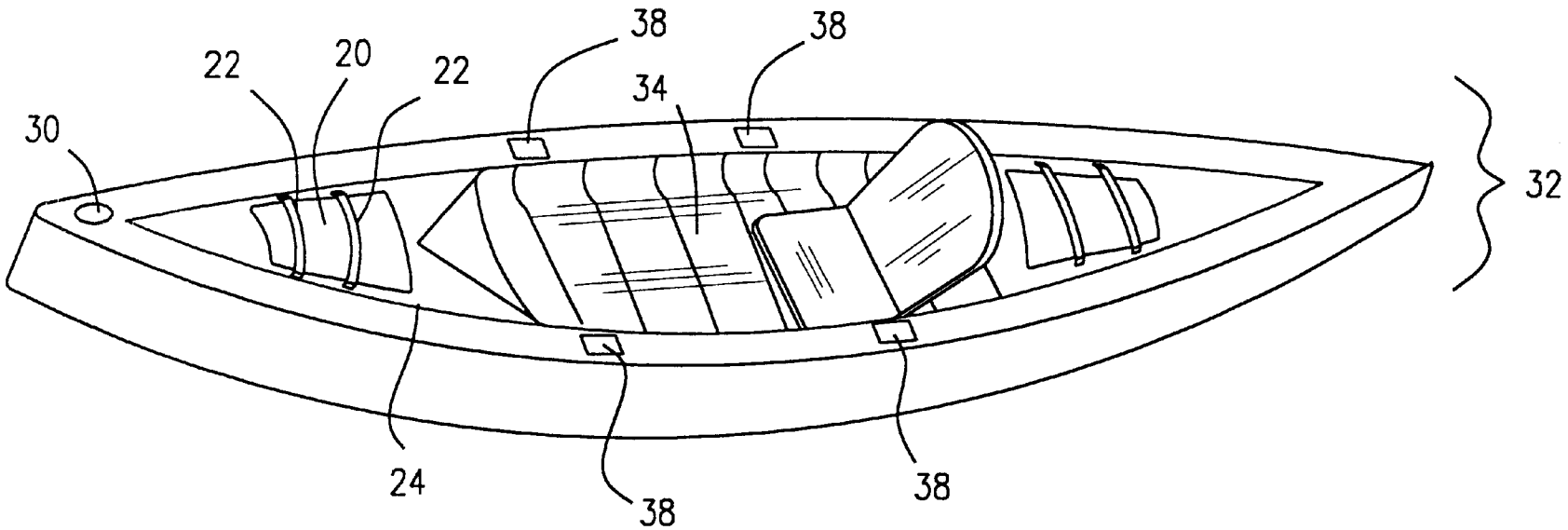
FIG. 1 is a side perspective view of an open-trough kayak, depicting its shallow trench and two storage wells with hatches secured.

In the drawings, the sail assembly for the invention is generally in the form of a mast mounting-plate 10, shown as having a cross member 12, and two mast-brackets 14 for attaching a bi-pod mast 16, with four strap notches 18. The cross member 12 has a plurality of apertures 13, two of which are located near each terminus for securing rigging to prevent the mounting plate 10 from sliding forward under pressure from behind, and one in the center for retaining the assembly in the aft position. Whether manufactured out of wood—in a preferred construction—or of some other material, the mast mounting-plate 10 is designed to be of substantially the same shape and size as the front storage well hatch 20 shown in FIG. 1. Two strap notches 18 are placed along both exterior edges of the mast mounting plate 10 in a manner to align with restraining straps 22 used to secure the well hatch 20 in place. The mounting plate 10 is placed over the top of the well hatch 20, and is secured in place by extending restraining straps 22 through the strap notches 18 and over the top of the mounting plate 10, and tightening them down using buckle clamps 24. In a preferred embodiment, a Velcro adhesive fastener is affixed between the bottom of the mounting plate 10, and the top of the well hatch 20, for a more secure bond.

The bi-pod mast 16 is then fastened to the mast brackets 14 via a single screw or peg 26, to permit the mast 16 to freely move fore and aft about the screw or peg's axis.

Figure 2:
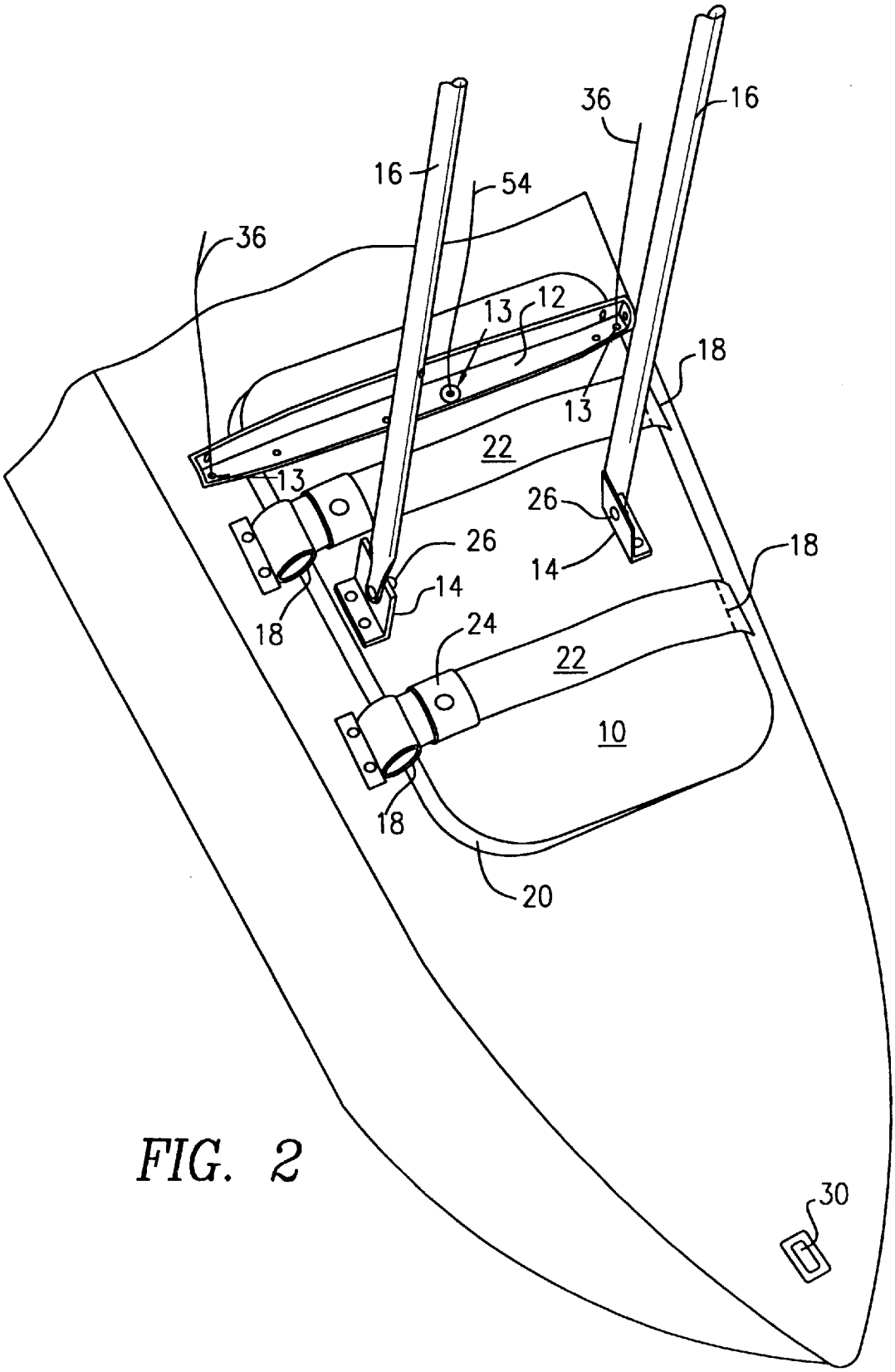
FIG. 2 is top perspective view showing the mast mounting-plate of the sailing accessory kit of the invention installed over the front storage well hatch, and with its bi-pod mast and cross member secured thereto.

To install the sail aspect of the sailing accessory kit, the user merely opens the buckle clamps 24, and then folds back the restraining straps 22 to expose the well hatch 20. The mast mounting plate 10 is then placed over the well hatch 20 so that the strap notches 18 are aligned with the restraining straps 22, and are then pressed into place causing one Velcro adhesive half on the top of the well hatch 20 to grip the Velcro adhesive half on the bottom of the mast mounting plate 10. The restraining straps 22 are then brought through the strap notches 18 and across, the top of the mast mounting plate 10, re-locking the buckle clamps 24, thereby further securing the mounting plate 10(FIG. 2).

The top of the bi-pod mast 16, is then secured to the mooring point 30 located at the front of the open-trough kayak 32 (FIG. 1) by bow rigging 28, thereby limiting rearward range of motion for the mast 16. The bow rigging 28 is of a length which permits the top of the bi-pod mast 16 to be brought back over the front of the cockpit 34 to a pre-set position. The aft rigging 36 is then secured from the outer apertures 13 to the front leg strap tie down points 38 located at the side gunwales of the kayak 32. In this manner, additional support is given to the mast mounting plate 10 to prevent it from sliding forward during use in windy conditions. Once the mounting plate 10 and the bi-pod mast 16 are secured, the sails can be attached.

Figure 4:
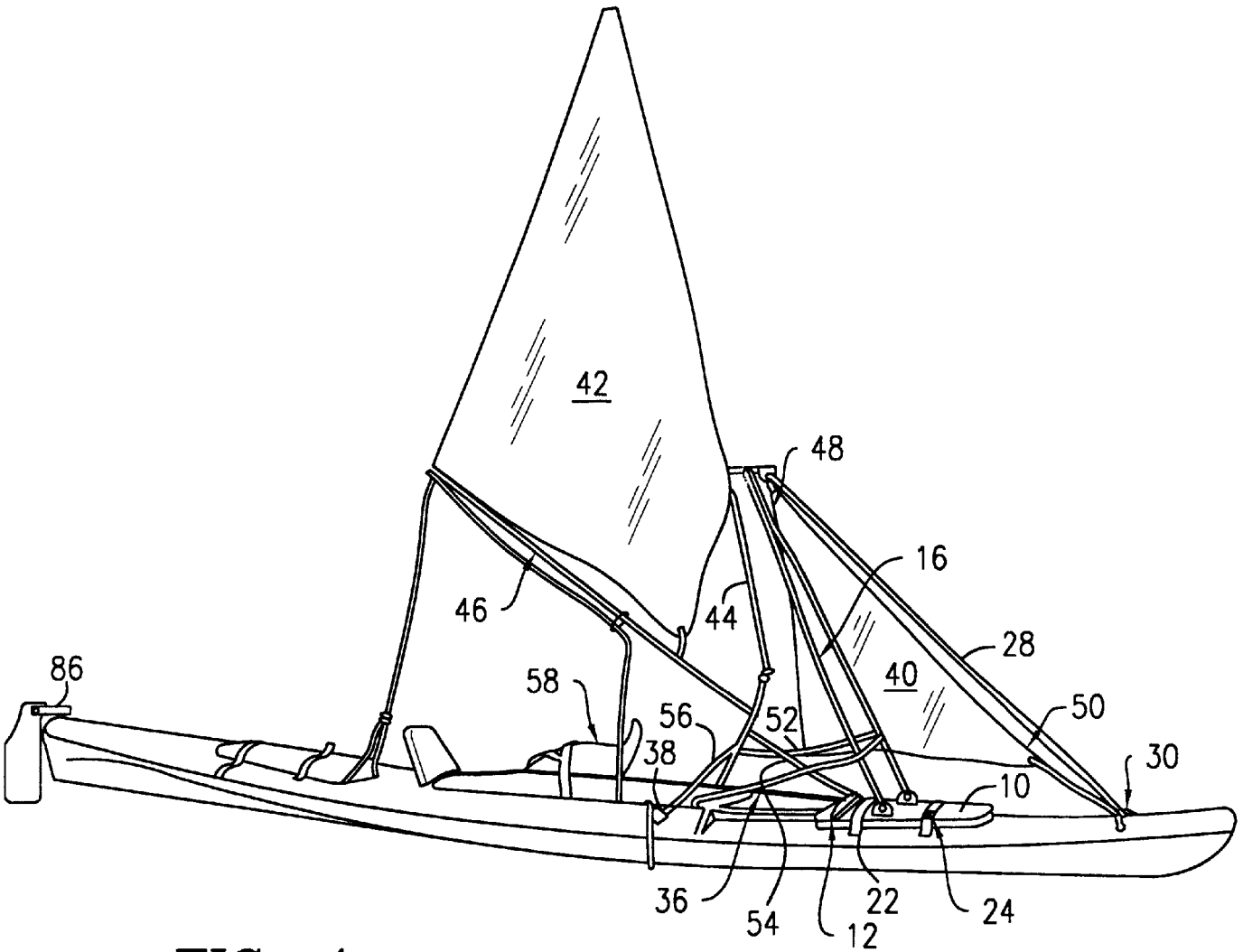
FIG. 4 is a side view of an open-trough kayak having the sailing accessory kit and the leeboard kit fully installed, ready to sail.
Figure 5:
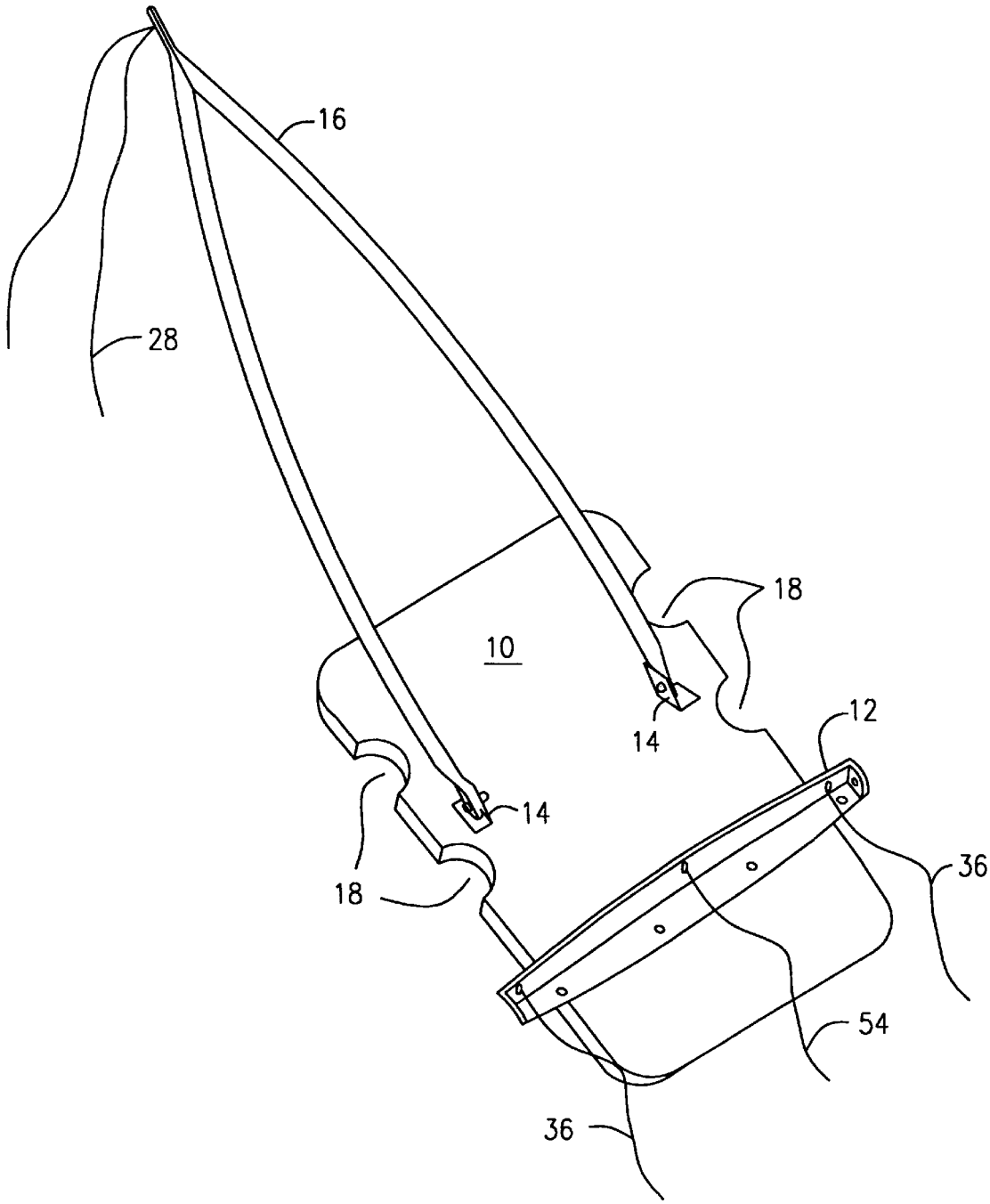
FIG. 5 is a top view of the mast assembly of the sailing accessory kit, including the mast mounting plate, the bi-pod mast in its folded carrying position, the cross member securement and the associated rigging for installation.

A jib 40 (FIG. 4) is fastened at its top corner 48 to the top of the bi-pod mast 16, and its front corner 50 is then fastened to the mooring point 30 causing the leading edge of the jib 40 to become taut when the bi-pod mast 16 is brought astern into its quiescent position. The rear corner of the jib 52 can be removably secured to the appropriate side of the kayak 32 as sailing conditions and heading require, utilizing rigging affixed to the sail itself. A main sail 42 is then slung from the top of the bi-pod mast 16 via a secondary main sail mast 44 (also known as a "yard"), which extends upwardly and rearward from the point of connection. The lower terminus of the main sail mast 44 is fastened to the front terminus of a main sail boom 46, which extends rearward for the attachment of the main sail 42, holding the sail open in its traditional triangular shape.

A front terminus of the main sail boom 46 is then fastened to center aperture 13 of the cross member 12 of the mounting plate 10, via a mast tensioner 54, which in conjunction with a boom stay 56, also affixed at the front terminus of the main sail boom 46, preventing the bi-pod mast 16 from falling forward when running with the wind (which pushes on the mast from behind). The boom stay 56 is fastened at its ends to the front leg strap tie down points 38 alongside the aft rigging 36. In addition, it is this combination which positions the center of the main sail 42 over the center of the kayak 32, transferring the forces to the kayak 32 at the mounting plate 10, and the front leg strap tie down points 38.

As will be understood, a person trying to sail the kayak 32 at this point would find it difficult to use, even after a rudder were attached to its stern. Given the shallow nature of the hull of the kayak 32, the lateral forces transferred to the hull during tacking—harnessing the wind coming over the gunwales and converting it into forward motion—would cause the kayak to merely slide sideways across the surface of the water. To prevent such an occurrence, a leeboard kit may be further employed according to the invention, which in its operative state, extends a leeboard 58 down below the surface of the water to resist the lateral forces exerted on the hull—in enabling the kayak 32 to maintain a truer heading.

Figure 3:
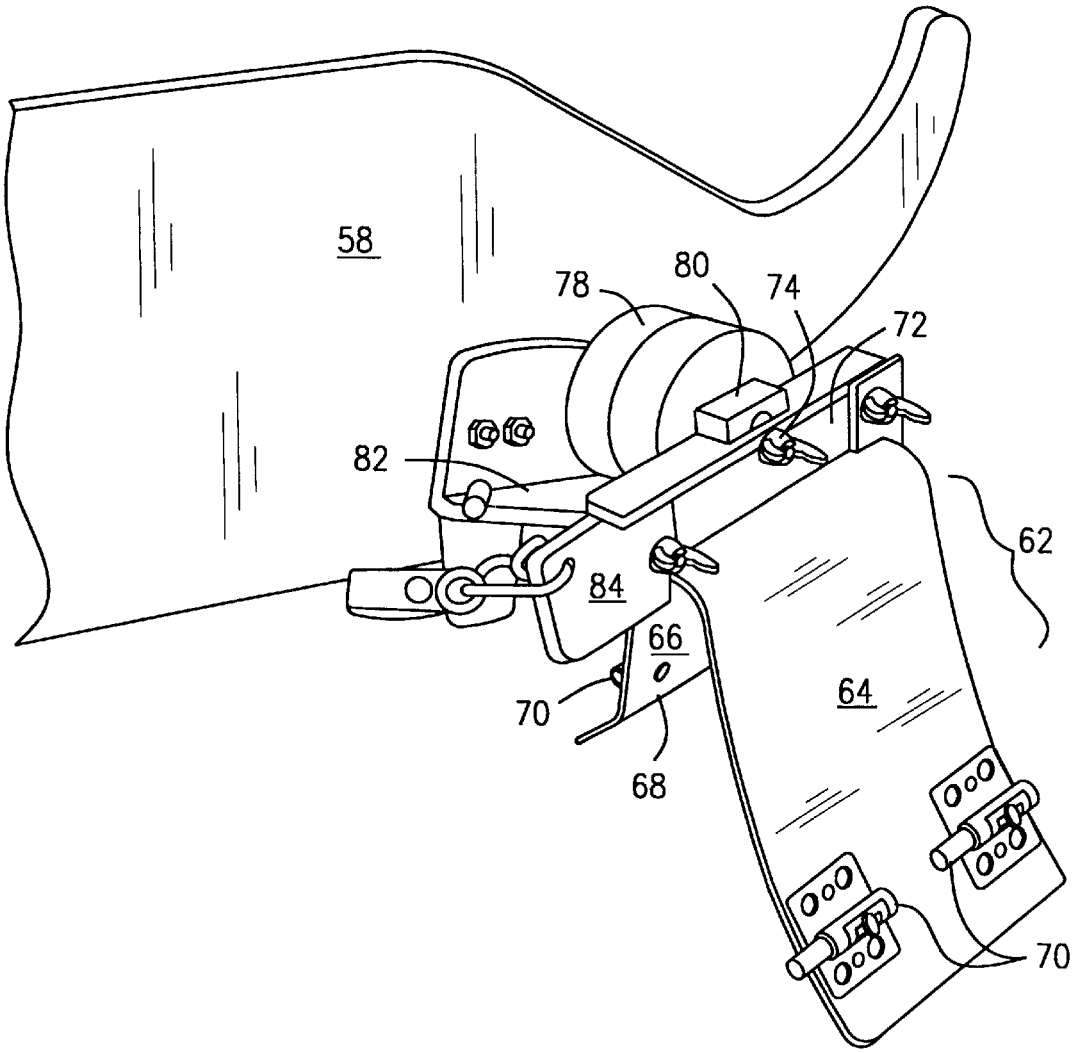
FIG. 3 is a side perspective view of the leeboard kit of the preferred embodiment, showing a clamping arrangement, a securement pulley for its rudder system, and the flat tapered board rotated into an upright/raised position.
Figure 6:
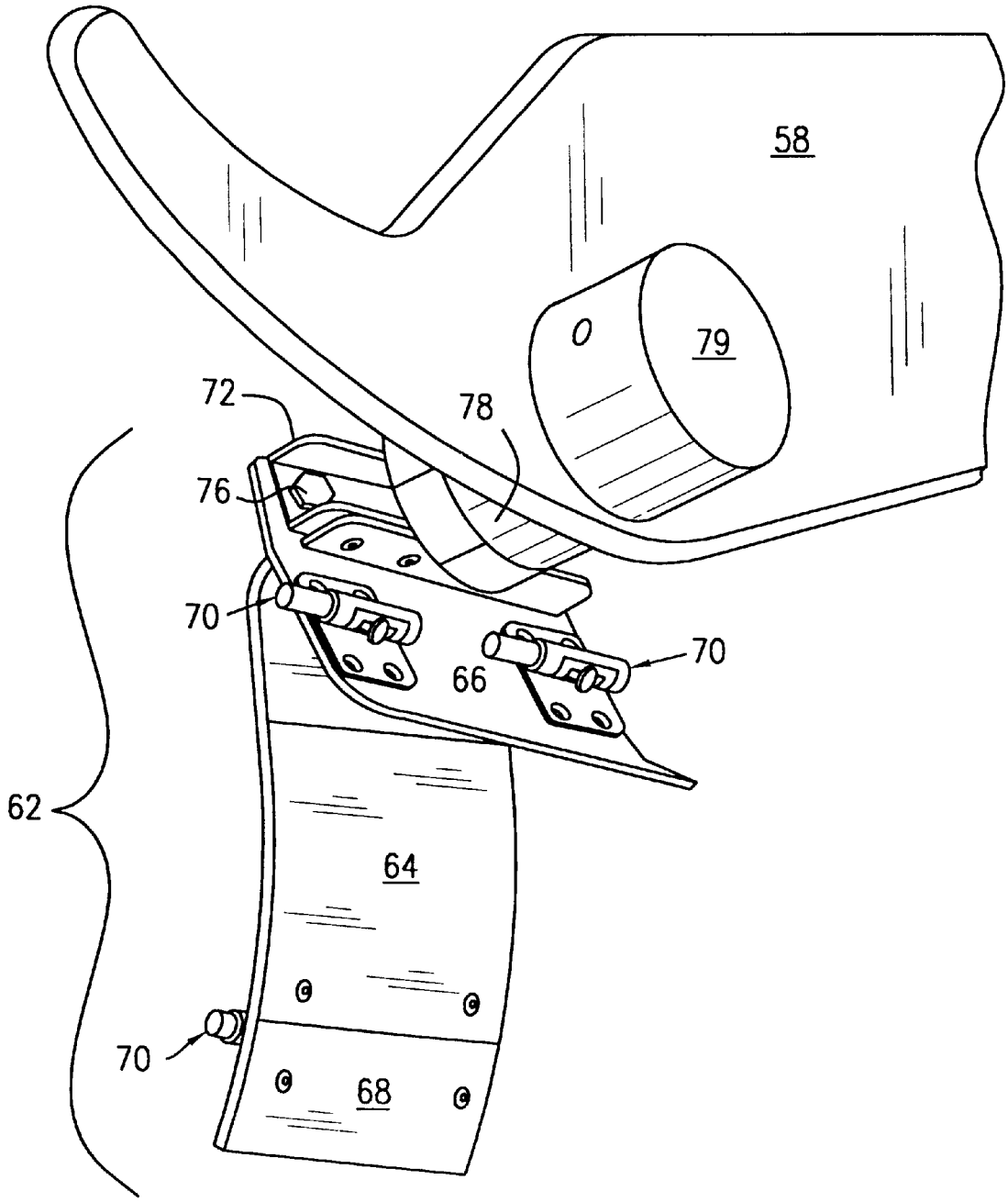
FIG. 6 is a bottom perspective view of the preferred leeboard embodiment helpful in an understanding of its operation.

In accordance with this aspect of the invention, the leeboard 58 is constructed of a strong, lightweight, buoyant, rigid material such as wood or plastic, having a rounded lower terminus to reduce drag and hang-up if it were to accidentally contact obstacles in the water. In a preferred embodiment, its upper terminus is formed in a manner to act as a handle 60 for both carrying and actuation during use(FIG. 3). As there are no crossbars, or other structural extensions on the kayak 32 to secure to the leeboard 58, a removable mounting bracket 62 is provided to attach to the gunwale of the kayak 32 towards the midpoint of the cockpit 34. The mounting bracket 62 includes an inner long tongue 64 and an outer short tongue 66, molded in a manner as to be substantially similar in shape to the perimeter of the kayak's gunwales so as to snugly slide thereon (FIG. 6). Affixed to the inner surfaces of the mounting bracket 62 are Velcro adhesive strip halves 68 to mate with other Velcro adhesive strip halves installed on the gunwale itself. To provide additional support, and to lock the bracket 62 in place, a pair of slide-bolt latches 70 are attached to the face of the inner long tongue 64, and to the outer short tongue 66, with corresponding receptacles mounted to the inside and outside of the gunwales. Extending outwardly from the apex of the mounting bracket 62 is a rigid, strong channel 72 which runs the width of the mounting bracket 62, and including a plurality of holes to receive screws, bolts or other fasteners, along with a square notch 74 at its top edge. A matching inset track 76 is utilized, also including a plurality of holes which align with those of the channel 72 to permit the two tracks to be removably mated together via appropriate connectors, and by its own matching square notch 74 along its top edge.

In one embodiment of the invention, the inset track 76 is permanently affixed to a pivoting cylinder 78, of diameter sufficient to resist bending forces, and of a length just long enough to extend out beyond the side of the kayak. The pivoting cylinder 78 has a locking protrusion 80 extending from its core, of substantially the same dimension as that of the square notches 74 of the channel 72 and the inset track 76. When the inset track 76 and the pivoting cylinder 78 are affixed, the locking protrusion 80 extends through the square notches 74 to resist rotating about its center axis. Thus, when the combination inset track 76 and the pivoting cylinder 78 are joined with the channel 72, the locking protrusion 80 extends through both square notches of the inset track 76 and the channel 72, to prevent the combination from sliding in any manner. Bolts may then be passed through the plurality of holes in both tracks, and "wing-nutted" tightly together, for example, to form a single rigid unit. Before installing the rear-most wing-nut, a rigging tab 84 may be placed over the bolt, and tightened for the attachment of rigging for controlling a rear mounted rudder 86, according to the invention.

The opposite end of the pivoting cylinder 78, on the other hand, is permanently fixed to the leeboard 58, beneath the level of the handle 60, and has an integrated flange 82 which contacts the channel 72 when the leeboard 58 is moved into its elevated position, thereby limiting its range of motion. In this construction, the pivoting cylinder 78 is preferably a combination of two cylinders joined together so that one may rotate about the other when a strong twisting force is applied, but remain fixed under pressure typically exerted by the resistive forces of water pushing against the leading edge of the leeboard 58 to which the pivoting cylinder 78 is attached. If, however, the leeboard 58 contacts a rock, or other obstruction, the force would be great enough to cause the pivoting cylinder 78 to rotate about its axis, permitting the leeboard 58 to be raised up out of the water—thereby preventing structural damage to the leeboard 58, and a tossing about of an occupant of the kayak 32 when the kayak 32 would have otherwise lurched to a halt.

In a second embodiment of the leeboard kit, the pivoting cylinder 78 is replaced with a single fixed portion cylinder 79, of substantially the same dimension as that of the pivoting cylinder 78. The single fixed portion cylinder 79 then accepts the leeboard 58, which is modified to slide onto and rotate about the single fixed cylinder 79 in a manner substantially identical to that of the leeboard 58 when being employed with the pivoting cylinder 78. The modified leeboard 58 is kept in place via the friction caused by a tight fit over the single fixed portion cylinder 79 and/or by resistance applied to the second end of the single fixed portion cylinder 79 after it is inserted through the modified leeboard.

To ready the kayak for use, all that needs to be done is to then connect the control lines for the rudder 86 to the rigging tab 84 to hold it in an easily reachable position.

In use of both the sailing accessory kit and the leeboard kit of the invention, the owner of the open-trough kayak can use it as it was originally designed—i.e., carrying it by hand, loading it on top of a roof rack, and paddling without obstruction, as the only modification to the craft was the attachment of some Velcro adhesive strips, and the attachment of slide-bolt latches 70 to the gunwales. When the user desires to convert the kayak into a sailing vessel, he or she merely slides the mounting bracket 62—which is typically left attached to the leeboard 58—and the rigging tab 84 over the gunwale which is fitted with the Velcro, and engages the slide-bolt latches 70 to lock it in place. After the mounting plate 10 is placed over the front well hatch 20, and secured in place via the adjustable restraining straps 22, the bi-pod mast 16 is tied into place by securing the bow rigging 28 to the mooring point 30, and by securing the mast tensioner 54 to the bottom terminus of the main sail boom 46 after hanging the main sail 42. As will be appreciated, it is not a requirement for operation to hang the Jib 40, although its increased surface area will make the kayak 32 move faster under light wind condition.

When disassembled, the sail accessory kit of the invention can be collapsed and rolled up to fit in a shoulder slung duffle bag, with the separate leeboard kit of the invention being easily transportable by the formed handle. As such, the invention becomes suitable for use at beaches, carrying the equipment, characteristically light in weight, over sand dunes and the like, as that is the typical place where open-trough kayaks are most frequently used.

While there have been described what are considered to be preferred embodiments of the present invention, it will be readily appreciated by those skilled in the art that modifications can be made without departing from the scope of the teachings herein. Thus, whereas, slide-bolt latches have been depicted, it will be acknowledged that any other locking and/or securing arrangement can be employed—dependent upon a user's preference. Additionally, while a plurality of holes have been described for securing the leeboard tracks together, it will be understood that one, or even none, can be employed and still carry out the principles underlying the invention. Lastly, although the mounting plate is described as being attached over a forward storage hatch, it will appreciated that it may be secured instead to the front of a kayak which has no storage well or hatch—by either strapping it down against the kayak, or more appropriately by sandwiching a malleable material such as rubber between the kayak and the mounting plate for a more secure fit. For at least such reasons, therefore, resort should be had to the claims appended hereto for a true understanding of the scope of the invention.

I claim:

1. An open-trough kayak leeboard kit comprising:

a mounting bracket of general U-shape design which slides over a gunwale of said kayak;

a cylinder removably coupled at one end to said mounting bracket; and a leeboard coupled to an opposite second end of said cylinder, raisable and lowerable into position by rotating about the center axis of said cylinder;

wherein said mounting bracket includes inboard and outboard tongues having exterior surfaces to secure said bracket to said kayak;

wherein said outboard tongue of said mounting bracket is shorter than said inboard tongue to rest on a top surface of said gunwale without extending below a water-line of said kayak;

wherein said cylinder includes an integrated channel with an outboard orientation for attaching said cylinder to said mounting bracket.

2. The kayak leeboard kit of claim 1 wherein said inboard tongue and outboard tongues also have Velcro adhesives to mate with Velcro adhesives on said gunwale of said kayak.

3. The kayak leeboard kit of claim 1 wherein said integrated channel includes a square notch centered along a top edge thereof.

4. The kayak leeboard kit of claim 3 wherein said integrated channel includes a first plurality of holes for securing said cylinder to said leeboard.

5. The kayak leeboard kit of claim 1 wherein said leeboard is immovably fixed to said second end of said cylinder, and wherein said cylinder includes two mated halves which rotate about each other when forces exerted on a leading edge of said leeboard exceed that of water resistance.

6. The kayak leeboard kit of claim 1 wherein said cylinder is of a single fixed portion, and wherein said leeboard is coupled to said cylinder to rotate thereabout when forces exerted on a leading edge of said leeboard exceed that of water resistance.

7. The kayak leeboard kit of claim 1 wherein an inboard terminus of said cylinder includes an integrated inset track of slightly smaller dimension than that of said integrated channel so as to tightly mate when inserted therein.

8. The kayak leeboard kit of claim 7 wherein said inset track include a second plurality of holes which align with said first plurality of holes of said integrated channel for securement therewith by an added bolt/screw connector.

9. The kayak leeboard kit of claim 8 wherein a square protrusion of slightly smaller dimension than that of said square notch is included to extend above a center of said inset track, so as to tightly mate with said square notch when inserted therewith, thereby adding an additional twisting resistance.

10. The kayak leeboard kit of claim 8 wherein a rigging tab is included, placed over a rear hole of said first and second plurality of holes prior to affixing said bolt/screw connector, for attachment of a rudder control line.

11. The kayak leeboard kit of claim 1 wherein said opposite second end of said pivoting cylinder is affixed to said leeboard in a permanent, non-removable fashion.

12. The kayak leeboard kit of claim 1 wherein said cylinder is of a length to permit said leeboard to clear a side of said kayak for lowering into the water.

13. The kayak leeboard kit of claim 12 wherein said cylinder and said leeboard are each composed of a rigid lightweight buoyant material impervious to salt water.

14. The kayak leeboard kit of claim 12 wherein said leeboard includes an inwardly extending flange to contact said inset track when said leeboard is in its rotated, raised position, to limit its range of rotation.

15. The kayak leeboard kit of claim 12 wherein said leeboard is of a long, flat, blade-like design to slice through water in a fore-aft direction.

16. The kayak leeboard kit of claim 12 wherein an upper terminus of said leeboard is generally in the shape of a handle for easy carrying and manipulation during use.

17. The kayak leeboard kit of claim 12 wherein said leeboard is attached to said cylinder just below said upper terminus.

18. The kayak leeboard kit of claim 1 wherein said leeboard is of a long, flat, blade-like design to slice through water in a fore-aft direction.

19. The kayak leeboard kit of claim 1 wherein the combined weight of said mounting bracket, said cylinder, and said leeboard is insufficient to cause said kayak to list when said kit is installed.

* * * * *